US006179894B1

(12) United States Patent
Gay

(10) Patent No.: US 6,179,894 B1
(45) Date of Patent: Jan. 30, 2001

(54) METHOD OF IMPROVING COMPRESSIBILITY OF A POWDER AND ARTICLES FORMED THEREBY

(75) Inventor: David Earl Gay, Pendleton, IN (US)

(73) Assignee: Delphi Technologies, Inc., Troy, MI (US)

( * ) Notice: Under 35 U.S.C. 154(b), the term of this patent shall be extended for 0 days.

(21) Appl. No.: 09/450,212

(22) Filed: Nov. 29, 1999

(51) Int. Cl.[7] ..... B22F 1/02; B22F 3/12

(52) U.S. Cl. ..... 75/230; 75/246; 419/10; 419/35; 419/37; 419/38

(58) Field of Search ..... 419/35, 10, 37, 419/38; 75/230, 246

(56) References Cited

U.S. PATENT DOCUMENTS 4,129,443 * 12/1978 Kaufman ..... 75/212
4,320,080 * 3/1982 Esper et al. ..... 264/111
4,977,710 * 12/1990 Une ..... 51/309
5,227,235 * 7/1993 Moro et al. ..... 428/357
5,352,522 * 10/1994 Kugimiya et al. ..... 428/403
5,478,409 * 12/1995 Takahashi ..... 148/104
5,885,653 * 3/1999 Waldenstrom et al. ..... 427/217
5,887,242 * 3/1999 Nygren et al. ..... 419/35
5,982,073 * 11/1999 Lashmore et al. ..... 310/254
5,993,729 * 11/1999 Lefebvre et al. ..... 419/2

* cited by examiner

*Primary Examiner*—Daniel J. Jenkins
(74) *Attorney, Agent, or Firm*—Margaret A. Dobrowitsky

(57) ABSTRACT

A method for producing high-density powder metallurgy articles formed of hard powder materials, and particularly hard ferromagnetic materials that yield powder metallurgy magnets exhibiting improved magnetic properties as compared to powder metallurgy magnets formed of pure iron. The method generally entails the use of a powder of a material that is harder than iron, and then encapsulating each particle of the powder with a layer of iron. The powder is then compacted, by which the particles are adhered together to form a powder metallurgy article. As a result of forming a sufficiently thick encapsulating layer of iron on each powder particle, the powder can be compacted to a greater density than would be possible without the encapsulating layer of iron. If a ferromagnetic material is used, the resulting magnetic article is capable of exhibiting magnetic properties superior to a substantially identical pure iron powder metallurgy magnet.

26 Claims, No Drawings

METHOD OF IMPROVING COMPRESSIBILITY OF A POWDER AND ARTICLES FORMED THEREBY

TECHNICAL FIELD

The present invention generally relates to powder metallurgy processes. More particularly, this invention relates to a process for improving the compressibility of relatively hard powders, and particularly iron alloy and ferromagnetic powders used to form magnets, so as to improve the magnetic properties of such magnets.

BACKGROUND OF THE INVENTION

The use of powder metallurgy (P/M), and particularly iron and iron alloy powders, is known for forming magnets, including soft magnetic cores for transformers, inductors, AC and DC motors, generators, and relays. An advantage to using powdered metals is that forming operations, such as compression molding, injection molding and sintering techniques, can be used to form intricate molded part configurations without the need to perform additional machining and piercing operations. As a result, the formed part is often substantially ready for use immediately after the forming operation.

To date, virtually all powder metal cores for AC electromagnetic applications have been formed of compacted particles of pure iron. As used herein, pure iron is defined as iron with only incidental impurities. As known in the art, pure iron is a soft magnet material that exhibits good magnetic properties and, being highly compressible (i.e., relatively soft and deformable), can be used in powder form to mold parts with reasonably high densities. For example, with the use of appropriate lubricants and/or binders, densities of 98% of theoretical can be achieved. However, many applications for magnets would benefit if a ferromagnetic material of better magnetic properties were used. Examples of such materials include soft magnet materials such as iron alloys, nickel and its alloys, cobalt and its alloys, iron-silicon alloys, iron-phosphorus alloys, iron-silicon-aluminum alloys, ferrites and magnetic stainless steel alloys. In addition, permanent ("hard") magnet materials that might be used include ferrites, iron-rare earth metal alloys, samarium alloys, and ceramic materials. As understood in the art, the terms "soft magnet" and "hard magnet" do not designate the physical hardness of a material, but its relative coercive field strength, with hard magnet materials being capable of exhibiting a very high coercive force that is retained after the magnetizing force is withdrawn. In terms of physical hardness, all of these materials are significantly harder than pure iron. As a result, these iron alloy materials are not widely used to produce powder metallurgy articles because of their poor compressibility, often resulting in molded densities of not more than 85% of theoretical, even with the use of lubricants and binders. The low density of a powder iron alloy magnet significantly limits its magnetic properties compared to an otherwise identical magnet formed with high density pure iron. Another detrimental effect of low density is lower green strength. While sintering improves the strength of a powder metallurgy article, sintering is inappropriate for some applications, such as AC magnets that require individual powder particles to be insulated from each other with a polymeric coating, and permanent magnets that cannot withstand the high temperatures required for sintering.

In view of the above, it would be desirable if a method were available that enabled hard, lower-compressible materials to be used to produce powder metallurgy articles, and particularly hard alloy iron materials to produce powder metallurgy magnets that exhibit magnetic properties superior to pure iron powder metallurgy magnets.

SUMMARY OF THE INVENTION

The present invention is directed to a method for producing high-density powder metallurgy articles formed of hard powder materials, and particularly hard alloy iron powders that yield powder metallurgy magnets exhibiting improved magnetic properties as compared to powder metallurgy magnets formed of pure iron. The method of this invention generally entails the use of a powder that is harder than pure iron, and then encapsulating each particle of the powder with a layer of pure iron. The powder is then compacted, by which the particles are adhered together to form a powder metallurgy article. As a result of forming a sufficiently thick encapsulating layer of iron on each powder particle, the powder can be compacted to a greater density than would be possible without the encapsulating layer of iron. If a ferromagnetic material is used, the resulting magnetic article is capable of exhibiting magnetic properties superior to a substantially identical pure iron powder metallurgy magnet.

In view of the above, it can be appreciated that this invention provides for the production of high-density powder metallurgy articles and magnets formed of relatively hard powder materials that normally exhibit low density when compacted. For magnet applications, the benefits made possible by the use of relatively hard ferromagnetic materials include lower-weight magnets to achieve a given magnet performance, and higher magnetic output for identical magnet mass. More generally, ferromagnetic materials having better magnetic properties than pure iron can be used to produce net-shape powder metallurgy magnets that can, depending on their compositions, exhibit lower hysteresis, higher permeability, higher maximum induction, higher low-frequency outputs, reduced heat loss and higher efficiencies than possible with pure iron magnets. Lower production costs, reduced scrappage and more design flexibility are also potential advantages to producing net-shaped hard articles by the powder metallurgy technique of this invention.

Other objects and advantages of this invention will be better appreciated from the following detailed description.

DESCRIPTION OF THE PREFERRED EMBODIMENT

According to the present invention, the compressibility of powders formed from materials harder than iron is improved by encapsulating the powder particles with a layer of iron. The invention is applicable to a wide variety of materials and is capable of producing various types of powder metallurgy articles, the principal example of this invention being powder metallurgy magnets formed of soft or hard magnet materials. Notable examples of soft magnet materials include iron alloys, nickel and its alloys, cobalt and its alloys, iron-silicon alloys, iron-phosphorus alloys, Fe—Si—Al alloys such as Sendust alloys (nominally Fe-5.6Al-9.7Si), and magnetic stainless steels. Permanent (hard) magnet materials can also be employed with this invention, such as ferrites, neodymium, iron-rare earth metal alloys, samarium alloys, and ceramic materials. A common trait of these materials is that they are all significantly harder than pure iron, i.e., greater than about 120 Rockwell B. As a result, these materials exhibit poor compressibility, often yielding molded densities of not more than 85% of theoretical, even with the use of lubricants and binders. By encapsulating one of these hard materials with a layer of pure iron, the present invention can achieve significantly greater densities, e.g., 94% of theoretical and potentially higher.

A suitable average particle size range for the hard base materials employed by this invention is about 5 micrometers to about 1000 micrometers, with a preferred average size being about 50 to 150 micrometers. The iron layer can be present on the particles as a substantially uniform encapsulating layer that constitutes about 0.25% to about 50% weight percent of each particle. A more preferred amount of iron is believed to be about 5 to 15 weight percent of each particle in order to provide sufficient iron to promote compressibility, yet not so much iron as to cancel the magnetic improvements. As "pure iron," the encapsulating layer consists essentially of iron, with typical levels of impurities being possible. The amounts of iron specified above provide a sufficiently soft outer surface to enable the encapsulated hard particles to become more fully compacted, eliminating gaps between particles as a result of the iron layers deforming and flowing during compaction. The iron layer can be applied to the particles by various coating methods, including vapor deposition, electrochemical reaction and chemical reaction.

In addition to the iron encapsulating layer, the coated hard powders of this invention can also be encapsulated with a binder that further promotes compaction of the powder and, if allowed to remain within the powder metallurgy article after compaction, provides electrical insulation between the particles, thereby reducing core losses in applications such as an AC magnet. More particularly, suitable binders promote the lubricity of the coated particles and promote adhesion of the powder particles to each other, so that powder magnet articles can be produced from the iron-coated particles with still higher densities and green strengths, respectively. Binders for this purpose include nylons, polyetherimides such as Ultem® from General Electric, epoxies, phenolics, polyesters, silicones, and inorganic materials such as oxides, phosphates, silicates, and ceramics. If the article is to undergo sintering to fuse the powder particles, the binder must also be capable of burning off cleanly at suitable sintering temperatures. Binder materials that burn off cleanly in addition to promoting lubricity include organic materials such as poly(alkylene carbonates), polypropylene oxide (PPO) polymer systems such as NORYL® from General Electric, waxes, low melting polymers, and silicones. The binder materials are preferably deposited on the powder particles to form a substantially uniform encapsulating layer, which may constitute about 0.05 to about 10 weight percent of each particle, preferably about 0.05 to about 0.75 weight percent of each particle. To further promote densities and eliminate the requirement for external die wall spray lubricants, the coated powder can be admixed with a lubricant, such as stearates, fluorocarbons, waxes, low-melting polymers and synthetic waxes such as ACRAWAX available from Lonza, Inc. A lubricant is preferably admixed with the powder in amounts of about 0.05 to about 10 weight percent of the powder, more preferably about 0.05 to about 0.3 eight percent of the powder. Suitable methods for coating the powder with binders and lubricants are well known in the art, and include solution blending, wet blending and mechanical mixing techniques, and microencapsulation by Wurster-type batch coating processes such as those described in U.S. Pat. Nos. 2,648,609 and 3,253,944.

Once coated, the hard powder particles are compacted to form the desired article by such known methods as uniaxial compaction, warm pressing, isostatic compaction, forging, HIPping, dynamic magnetic compaction (DMC), extrusion, and metal injection molding. Compaction typically work-hardens the particles to some degree, reducing desirable magnetic properties such as permeability and increases hysteresis loses. Accordingly, if the insulating binder is an inorganic binder, a magnetic article produced by this invention can be annealed by heating to an appropriate temperature for the ferromagnetic material, followed by slow cooling. During annealing, any organic binder or lubricant on the ferromagnetic particles is typically volatilized. Alternatively, the polymer and/or lubricant can be removed by heating the article to an intermediate temperature prior to annealing. If the ferromagnetic particles are formed of an iron alloy, nickel, a nickel alloy, cobalt, a cobalt alloy, iron-silicon, iron-phosphorus, or Fe—Si—Al alloy, annealing can typically be performed within a temperature range of about 900° F. to about 1400° F. (about 480° C. to about 760° C.) for a duration that is dependent on the mass of the article.

After or instead of annealing, a powder metallurgy article produced by this invention may undergo sintering at a temperature appropriate for the hard particle material. Typical sintering temperatures are about 2050° F. to 2400° F. (about 1120° C. to 1315° C.). During sintering the iron encapsulating layers on the hard particles fuse, and to some extent soften and flow between and around the ferromagnetic particles to promote strength. As noted above, sintering is not performed if the particles were coated with a binder that is to remain as an insulating layer between particles. Furthermore, sintering is preferably not performed if harmful to the properties of the hard particle material, such as permanent magnet materials whose magnetic properties degrade if heated to a temperature at which recrystallization occurs, as is well known in the art.

The invention will now be further illustrated with reference to magnetic articles produced in accordance with the method described above. In a first example, a soft magnet core was produced from a 50Ni-50Fe alloy powder that was coated with iron using a chemical solution substitution reaction. The iron content on the individual powder particles was about 5 weight percent. A phenolic binder commercially available from OxyChem under the name Varcum was then coated onto the iron encapsulated powder using a solution blending process. ACRAWAX lubricant was then admixed into the powder to achieve a content of about 0.4 weight percent of the powder mixture, after which the powder was uniaxially compacted at a die temperature of about 250° F. (about 120° C.) with a pressing force of about 50 tons per square inch (50 tsi, approximately 770 MPa). The resulting powder metallurgy magnet had a density of about 93% of theoretical.

In another example, a soft magnet core was produced using a 49Co-49Fe-2V alloy powder whose particles were coated with iron by vapor deposition to achieve an iron content of about 7.5 weight percent. The iron encapsulated powder particles were then microencapsulated with an amorphous polyetherimide resin binder commercially available from General Electric under the name ULTEM, and then V-blended in accordance with well-known practice with an acrylic and TEFLON (TFE) as lubricants, to yield encapsulated particles with about 0.25, about 0.10 and about 0.10 percent, respectively, of their weight attributable to the binder, acrylic and TEFLON materials. The resulting powder was then heated to about 150° F. (about 65° C.) and uniaxially compacted at a die temperature of about 350° F. (about 175° C.) with a pressing force of about 55 tsi (approximately 850 MPa). The resulting powder metallurgy magnet had a density of about 95% of theoretical.

In a final example, a permanent magnet was produced in accordance with this invention using a Nd-2Fe-14B alloy powder available under the name MQP-B from Magnequench International. The particles of this alloy were coated with iron using a chemical solution substitution reaction to achieve an iron content of about 5 weight percent. The iron encapsulated powder particles were then microencapsulated with an epoxy binder commercially available from Shell Chemical under the name 164, and a polystyrene binder commercially available from Amoco under the name G2, to yield encapsulated particles with about 0.50 and about 0.25 percent, respectively, of their weight attributable to the epoxy and polystyrene coatings.

The resulting powder was then uniaxially compacted at a die temperature of about 250° F. (about 120° C.) with a pressing force of about 55 tsi (approximately 850 MPa). The resulting powder metallurgy magnet had a density of about 90% of theoretical.

While the invention has been described in terms of a preferred embodiment, it is apparent that other forms could be adopted by one skilled in the art. For example, while the invention has been described with particular focus on materials and processes for powdered metallurgy magnets such as soft magnetic cores, the teachings of this invention can also be applied to the molding of other types of articles from powders of materials harder than iron. Accordingly, the scope of the invention is to be limited only by the following claims.

What is claimed is:

1. A method for forming a powder metallurgy magnetic article, the method comprising the steps of:

providing a powder of a material that is harder than iron, the material being chosen from the group consisting of ferromagnetic materials, iron alloys, nickel and alloys thereof, cobalt and alloys thereof, iron-silicon alloys, iron-phosphorus alloys, iron-silicon-aluminum alloys, ferrites, magnetic stainless steel alloys, ferrites, iron-rare earth metal alloys, samarium alloys, and ceramic materials;

forming on each particle of the powder an encapsulating layer of iron; and then compacting the powder to adhere the particles together and form the powder metallurgy article.

2. The method according to claim 1, wherein the material is a ferromagnetic material.

3. The method according to claim 1, wherein the material is chosen from the group consisting of iron alloys, nickel and alloys thereof, cobalt and alloys thereof, iron-silicon alloys, iron-phosphorus alloys, iron-silicon-aluminum alloys, ferrites and magnetic stainless steel alloys.

4. The method according to claim 1, wherein the material is chosen from the group consisting of ferrites, iron-rare earth metal alloys, samarium alloys, and ceramic materials.

5. The method according to claim 1, wherein the encapsulating layer of iron constitutes about 0.25 to about 50 weight percent of the total mass of each particle.

6. The method according to claim 1, further comprising the step of, after the forming step and prior to the compacting step, depositing on each particle a binder material chosen from the group consisting of polymeric and inorganic binders.

7. The method according to claim 6, wherein the binder material constitutes about 0.05 to about 10 weight percent of the total mass of each particle.

8. The method according to claim 6, further comprising the step of sintering the powder metallurgy magnetic article so as to burn off the binder material and fuse the encapsulating layers of iron on the particles.

9. The method according to claim 1, further comprising the step of, after the forming step and prior to the compacting step, admixing a lubricant with the powder.

10. The method according to claim 8, wherein the lubricant constitutes about 0.05 to about 10 weight percent of the total mass of the powder.

11. A method for forming a powder metallurgy magnet, the method comprising the steps of:

providing a powder of a ferromagnetic material that is harder than iron;

forming on each particle of the powder an encapsulating layer of iron, the encapsulating layer of iron constituting about 0.25 to about 50 weight percent of the total mass of each particle; and then compacting the powder to deform the encapsulating layers of iron and adhere the particles together so as to form the powder metallurgy magnet.

12. The method according to claim 11, wherein the ferromagnetic material is a soft magnet material chosen from the group consisting of iron alloys, nickel and alloys thereof, cobalt and alloys thereof, iron-silicon alloys, iron-phosphorus alloys, iron-silicon-aluminum alloys, ferrites and magnetic stainless steel alloys.

13. The method according to claim 11, wherein the material is a permanent magnet material chosen from the group consisting of ferrites, iron-rare earth metal alloys, samarium alloys, and ceramic materials.

14. The method according to claim 11, wherein the encapsulating layer of iron constitutes about 1 to about 10 weight percent of the total mass of each particle.

15. The method according to claim 11, further comprising the step of, after the forming step and prior to the compacting step, depositing on each particle a binder material chosen from the group consisting of polymeric and inorganic binders, the binder material constituting about 0.05 to about 0.75 weight percent of the total mass of each particle.

16. The method according to claim 15, further comprising the step of sintering the powder metallurgy article so as to bum off the binder material and fuse the encapsulating layers of iron on the particles.

17. The method according to claim 11, further comprising the step of, after the forming step and prior to the compacting step, admixing a lubricant with the powder, the lubricant constituting about 0.05 to about 0.75 weight percent of the total mass of the powder.

18. A powder metallurgy magnetic article comprising a compacted powder of a material that is harder than iron, and an encapsulating layer of iron on each particle of the powder, the material being chosen from the group consisting of ferromagnetic materials, iron alloys, nickel and alloys thereof, cobalt and alloys thereof, iron-silicon alloys, iron-phosphorus alloys, iron-silicon-aluminum alloys, ferrites, magnetic stainless steel alloys, ferrites, iron-rare earth metal alloys, samarium alloys, and ceramic materials.

19. The powder metallurgy magnetic article according to claim 18, wherein the material is a ferromagnetic material.

20. The powder metallurgy magnetic article according to claim 18, wherein the material is chosen from the group consisting of iron alloys, nickel and alloys thereof, cobalt and alloys thereof, iron-silicon alloys, iron-phosphorus alloys, iron-silicon-aluminum alloys, ferrites and magnetic stainless steel alloys.

21. The powder metallurgy magnetic article according to claim 18, wherein the material is chosen from the group consisting of ferrites, iron-rare earth metal alloys, samarium alloys, and ceramic materials.

22. The powder metallurgy magnetic article according to claim 18, wherein the encapsulating layer of iron constitutes about 0.25 to about 50 weight percent of the total mass of the powder metallurgy magnetic article.

23. The powder metallurgy magnetic article according to claim 18, wherein the encapsulating layer of iron constitutes about 1 to about 10 weight percent of the total mass of the powder metallurgy magnetic article.

24. The powder metallurgy magnetic article according to claim 18, further comprising a binder material encapsulating each particle of the powder.

25. The powder metallurgy magnetic article according to claim 18, wherein the powder metallurgy article is sintered such that the encapsulating layers of iron are fused.

26. The powder metallurgy magnetic article according to claim 18, wherein the powder metallurgy magnetic article is a magnet.

* * * * *